US006513275B1

(12) United States Patent
Paige

(10) Patent No.: US 6,513,275 B1
(45) Date of Patent: Feb. 4, 2003

(54) MAGNETIC LIGHTWEIGHT COLLIMATOR

(75) Inventor: Clive Rawlinson Paige, Ascot (GB)

(73) Assignee: Fire Point International Limited, Windsor (GB)

( * ) Notice: Subject to any disclaimer, the term of this patent is extended or adjusted under 35 U.S.C. 154(b) by 0 days.

(21) Appl. No.: 09/641,753

(22) Filed: Aug. 21, 2000

(30) Foreign Application Priority Data

Sep. 1, 1999 (GB) ..... 9920455

(51) Int. Cl.[7] ..... F41G 1/54
(52) U.S. Cl. ..... 42/120; 42/130; 359/819
(58) Field of Search ..... 42/114, 115, 116, 42/120, 121, 130, 148; 359/819

(56) References Cited

U.S. PATENT DOCUMENTS 3,700,339 A * 10/1972 Steck, III ..... 356/247
4,054,002 A * 10/1977 Latona, Jr.
4,142,799 A 3/1979 Barton ..... 356/153
4,213,700 A 7/1980 Leblane ..... 356/73
4,390,276 A 6/1983 Budden et al. ..... 356/251
4,976,038 A * 12/1990 Nattrass ..... 42/100
5,189,245 A 2/1993 Bundy ..... 89/14.1
5,222,302 A * 6/1993 DeBatty et al. ..... 33/233
5,471,777 A * 12/1995 McDonald ..... 42/103
5,561,563 A * 10/1996 Chesnut et al. ..... 359/823
5,791,060 A * 8/1998 Godsey ..... 33/265

* cited by examiner

*Primary Examiner*—Stephen M. Johnson
(74) *Attorney, Agent, or Firm*—Greenberg Traurig, LLP; Paul F. McQuade; Paul L. Ratcliffe

(57) ABSTRACT

An optical collimator device for use in aligning a gun bore with a gun sight is formed of a graticule and lens which are located within the optical collimator device housing. The optical collimator device is mounted on the end of the gun barrel with a magnetic bar and rail structure formed in the optical collimator device housing and this magnetic bar and rail structure allows the optical collimator device to adjust vertically for use with guns with low sights and with raised sights and large bore diameters such as shotguns and baton guns.

6 Claims, 4 Drawing Sheets

MAGNETIC LIGHTWEIGHT COLLIMATOR

FIELD OF THE INVENTION

The present invention relates to bore sight collimators which are used to align a gun bore with a telescopic sight mounted to the gun.

BACKGROUND OF THE INVENTION

At present, when aligning a rifle bore with a telescopic sight, the procedure utilized is to take a suitably sized pin, which fits the bore of the rifle, without play, and then to clamp the optical collimator to the pin. The collimator is then aligned with the bore and, when the collimator optic is viewed through the telescopic sight on the rifle, an aiming grid is seen, which is then utilized to adjust the telescopic cross-wires. These systems are difficult to use as the pin in the bore is usually spring loaded against the side of the rifle bore, and the weight of the collimator will cause the pin to be misaligned.

Such existing arrangements are designed to be used with telescopic magnifying sights, so that the alignment pattern is not easily seen with the unaided eye since the pattern or grid is very small, and such devices are generally heavy since the optic is large and made of glass and the body thereof is metal. Such existing collimators are provided with a range of different size pins to fit a range of bore sizes. A magnetic version is also known but the magnet works only in one position and generally will not work on stainless barrels, since the magnet utilized is weak. Further, such previous arrangements are primarily intended to be utilized with rifles and are not suitable for use with hand guns where the iron sights are much lower and both pin and magnetic versions will not work on large bore guns such as shotguns or baton round guns.

SUMMARY OF THE INVENTION

It is the object of the present invention to provide a lightweight magnetic collimator which can be utilized on a variety of guns or rifles and can be utilized to align both low iron sights and telescopic sights, particularly, for example, on hand guns.

The present invention is an optical collimator device for use in aligning a gun bore with a gun sight is formed of a graticule and lens which are located within the optical collimator device housing. The optical collimator device is mounted on the end of the gun barrel with a magnetic bar and rail structure formed in the optical collimator device housing and this magnetic bar and rail structure allows the optical collimator device to adjust vertically for use with guns with low sights and with raised sights.

DETAILED DESCRIPTION OF THE PREFERRED EMBODIMENT

According to the present invention there is provided an optical collimator device with a graticule defining bore center line placed optically at infinity, characterized in that a high magnification optic is positioned in front of the graticule to enable the graticule to be read with the naked eye, and in that a linear magnetic track is provided which enables mounting of the device on the muzzle of a gun, permitting vertical adjustment of the collimator.

Figure 1:
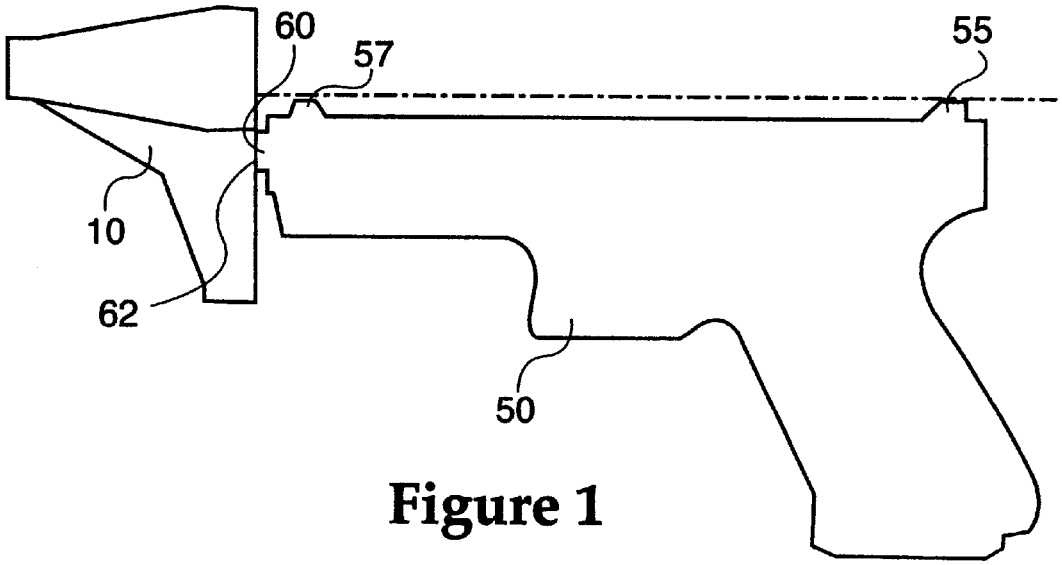
FIG. 1 is a side view of the present invention mounted on a hand gun.
Figure 2:
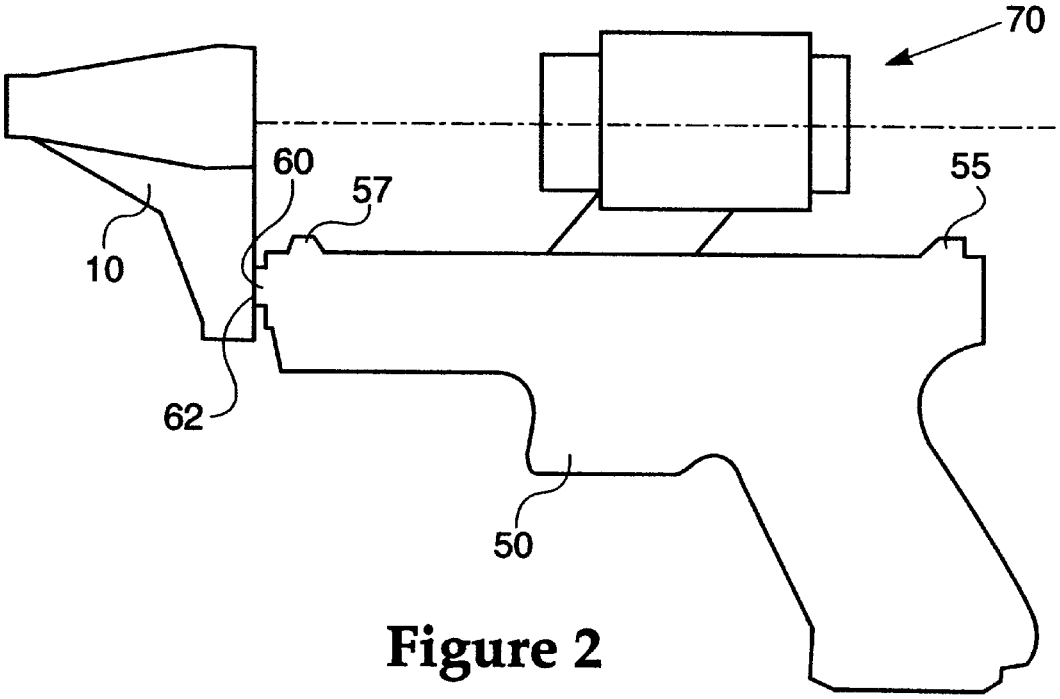
FIG. 2 is a side view of the present invention mounted on a hand gun with an attached raised sight.

As shown in FIGS. 1 and 2 an optical collimator device 10 is mounted to a gun 50. The gun 50 has a rear low iron sight 55, a front low iron sight 57, and a barrel 60. A muzzle 62 is located at the end of barrel 60. The optical collimator device 10, as will be described in more detail below, is mounted onto the end or muzzle 62 of the barrel 60.

As seen in FIG. 1 the optical collimator device 10 can be used on a hand gun with low iron sights 55, 57. The optical collimator device 10, as seen in FIG. 2, can also be used on a hand gun with a raised sight 70. In addition, the optical collimator device 10 can be used on any gun such as a rifle (not shown). The raised sight 70, seen in FIG. 2, may be any sight which is raised from the barrel of the gun and may include telescopic magnifying sights and electronic red dot sights.

Figure 3A:
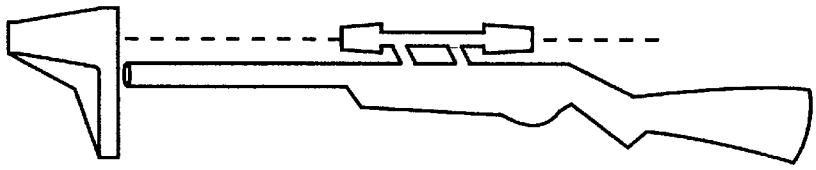
FIG. 3A is a side view of the present invention mounted on a rifle with a telescopic sight.
Figure 3B:
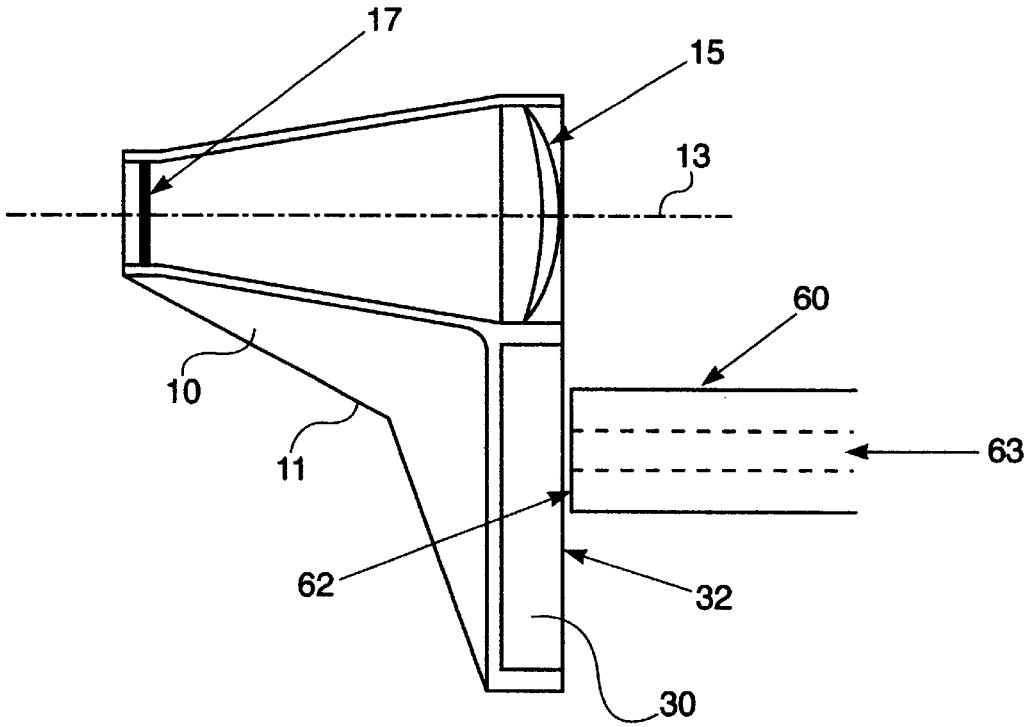
FIG. 3B is an enlarged detailed side view of the present invention depicted in FIG. 3A.

As seen in FIG. 3A a cross sectional side view of the optical collimator device 10 is displayed and mounted to a rifle 20 with a telescopic sight 22. FIG. 3B is an enlarged detailed side view of the optical collimator device 10 mounted on the end or muzzle 62 of the barrel 60 of the rifle 20 of FIG. 3A. The barrel 60 may be a short barrel, such as those used in a hand gun, or a long barrel, such as those used in a rifle, and has a bore 62. The optical collimator device 10 includes a housing 11, an optical lens 15, a graticule 17, and a magnetic mounting structure 30 for mounting the housing to a gun barrel.

In a preferred embodiment the housing 11 is constructed from plastics to reduce the weight of the optical collimator device 10. In addition, the optical lens 15 is preferably a high magnification optic. The optical lens 15 could be a plastic lens and the lens is preferably an aspherical lens to reduce the focal length and overall size. The side portions of the lens may further be removed to reduce the weight and overall size of the optical collimating device 10. The graticule 17 is a target or aiming grid which has a graticule defining bore center line 13 placed optically at infinity. The magnetic mounting structure 30 has a mating surface 32 which mates with the muzzle 62 when mounted in place.

Figure 4:
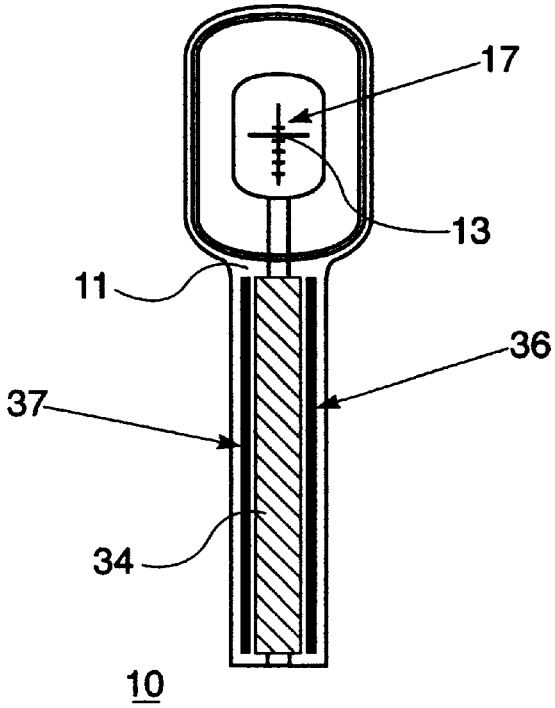
FIG. 4 is a front view of the present invention.
Figure 5:
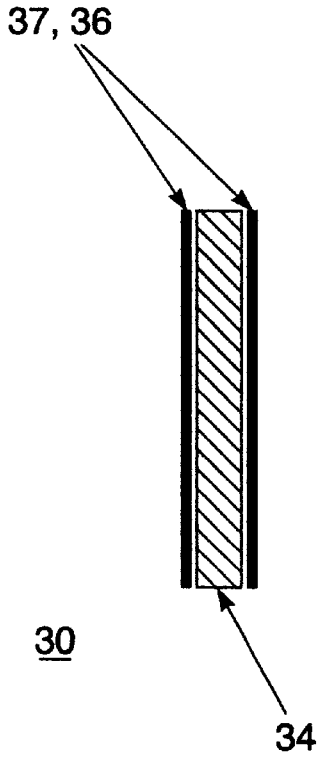
FIG. 5 is a front view of the magnetic structure of the present invention.

As seen in FIGS. 4 and 5, the magnetic mounting structure 30 preferably comprises a bar magnet 34 with steel side plates 36, 37 mounted in the plastic body 11 of the optical collimator device 10. The bar magnet 34 is of sufficient strength to allow for use on barrels with stainless steel content. The bar magnet 34 and rails 36, 37 enable the optical collimator device 10 to mount the end or muzzle 62 of a barrel 60, as seen in FIG. 3, yet still have the ability to vertically adjust the collimating device 10 to accommodate different heights of sights on a gun.

In addition, as seen in FIG. 4, the front view of the optical collimator device 10 also shows a front view of graticule 17. The graticule defining bore center line 13 is defined by the cross point of the vertical and horizontal line of the graticule 17.

Figure 6:
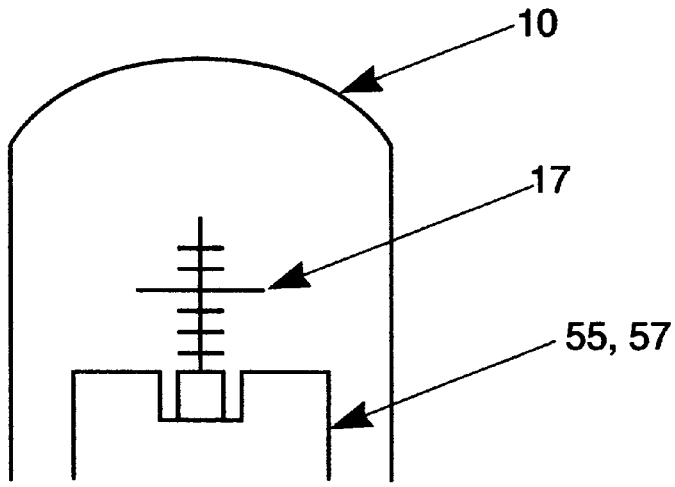
FIG. 6 is a front view of the present invention when mounted to the gun of FIG. 1.

FIG. 6 shows the view looking down the sight line of a gun with low iron type sights as depicted in FIG. 1. The optical collimator device 10 is mounted on the muzzle of a barrel, not shown, and adjusted vertically. By viewing the graticule 17 though the low iron sights 55, 57 the alignment of the low iron sights 55, 57 can be determined and then adjusted so that the low iron sights 55, 57 align with the graticule 17 of the optical collimator device 10.

Figure 7:
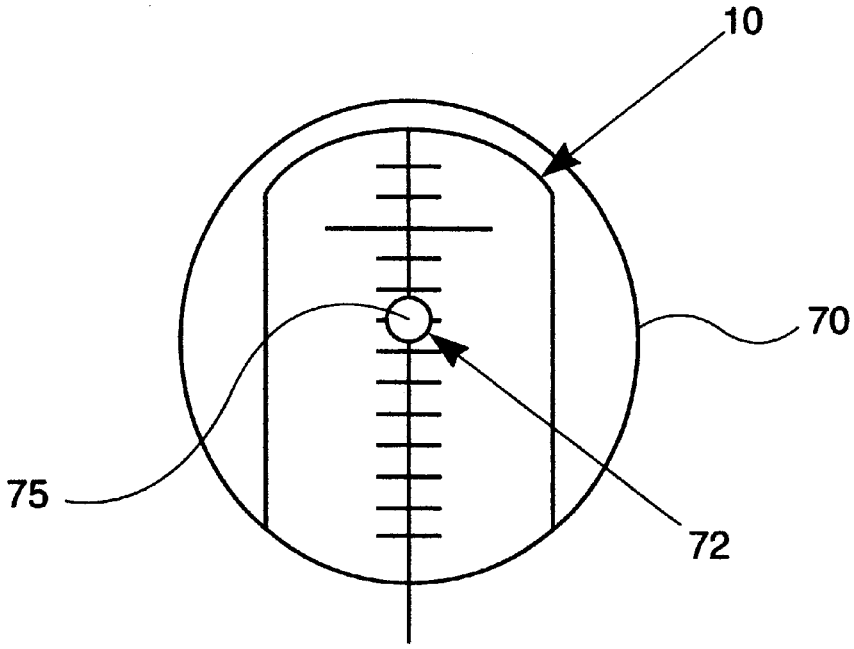
FIG. 7 is a front view of the present invention when mounted to the gun of FIG. 2.

FIG. 7 shows the view looking down the sight line of a gun with a raised electronic red dot sight 70, as seen in FIG. 2. The optical collimator device 10 is mounted on the muzzle of a barrel, not shown, and adjusted vertically. By viewing the graticule 17 though the powered red dot sight 70 the alignment of the powered red dot sight 70 can be determined. The powered red dot sight 70 can be adjusted so that the red dot 75 aligns to the proper location 72 on the graticule 17.

While the preferred embodiment and various alternative embodiments of the invention have been disclosed and described in detail herein, it will be apparent to those skilled in the art that various changes in form and detail may be made therein without departing from the spirit and scope thereof.

I claim:

1. An optical collimator device comprising:

a reticule mounted in a housing for use in aligning a sight and a boar of a gun;

a lens mounted in relation to said housing for viewing said reticule and said lens forming an optical collimator;

a magnetic bar for mounting said optical collimator device to a barrel of said gun, wherein magnetically attached to said optical collimator device adjusts vertically relative to said barrel; and a plurality of rails adjacent to said magnetic bar for aiding the alignment of said optical collimator device.

2. The optical collimator device of claim 1, wherein said housing is formed of a plastic material.

3. The optical collimator device of claim 1, wherein said lens is a magnifying optic.

4. The optical collimator device of claim 1, wherein said lens is plastic.

5. The optical collimator device of claim 1, wherein said lens is an aspherical lens.

6. The optical collimator device of claim 1, wherein said rails are steel rails.

* * * * *

UNITED STATES PATENT AND TRADEMARK OFFICE

CERTIFICATE OF CORRECTION

PATENT NO. : 6,513,275 B1
DATED : February 4, 2003
INVENTOR(S) : Clive Rawlinson Paige It is certified that error appears in the above-identified patent and that said Letters Patent is hereby corrected as shown below:

Title page,
Item [73], Assignee should read -- Fire Point International Limited, Windsor Berkshire SL4IGJ --

Signed and Sealed this

First Day of July, 2003

JAMES E. ROGAN
*Director of the United States Patent and Trademark Office*